US005906765A

United States Patent [19]

Miura et al.

[11] Patent Number: 5,906,765

[45] Date of Patent: May 25, 1999

[54] MICROWAVE OVEN

[75] Inventors: Takashi Miura; Kenji Kume; Hideki Yamauchi; Tsutomu Nishikawa, all of Otsu; Miho Fujii, Shiga, all of Japan

[73] Assignee: Sanyo Electric Co., Ltd., Japan

[21] Appl. No.: 09/061,470

[22] Filed: Apr. 16, 1998

[30] Foreign Application Priority Data

Apr. 28, 1997 [JP] Japan ..... 9-111180
Mar. 2, 1998 [JP] Japan ..... 10-049776

[51] Int. Cl.[6] ..... H05B 6/68

[52] U.S. Cl. ..... 219/720; 219/702

[58] Field of Search ..... 219/702, 704, 219/706, 715, 716, 720

[56] References Cited

U.S. PATENT DOCUMENTS

| | | | |
|---|---|---|---|
| 5,183,984 | 2/1993 | Nakagawa | 219/720 |
| 5,345,067 | 9/1994 | Ohta et al. | 219/720 |
| 5,495,095 | 2/1996 | Matteis et al. | 219/720 |
| 5,786,578 | 7/1998 | Christy et al. | 219/720 |
| 5,834,745 | 11/1998 | Aoki et al. | 219/720 |

FOREIGN PATENT DOCUMENTS 3-159094 7/1991 Japan .

*Primary Examiner*—Tu B. Hoang
*Attorney, Agent, or Firm*—Morrison Law Firm

[57] ABSTRACT

A microwave oven 10 including a main body 1 in which a heating chamber 2 is installed, a microwave supplying unit 3 installed at an inner portion of the main body 1 for heating a food incorporated in the heating chamber 2 by supplying microwave at a predetermined output, an operation panel 4 (input operating unit) for inputting cooking output information and cooking time information of the food, a control unit 6 for comparing the cooking output information inputted by the operation panel 4 with the predetermined output, correcting the inputted cooking time information in accordance with a result of the comparison and instructing to drive the microwave supplying unit 3 based on corrected cooking time obtained by the correction, wherein the control unit 6 includes buzzer 48 (information supplying means) for successively supplying the cooking time information inputted by the operation panel 4 and the corrected cooking time and supplying, after having supplied the cooking time information, information that the corrected cooking time is being supplied.

4 Claims, 9 Drawing Sheets

MICROWAVE OVEN

BACKGROUND OF THE INVENTION

1. Field of the Invention

The present invention relates to a microwave oven, particularly to a microwave oven which drives microwave heating means based on cooking information inputted by an input operating unit.

2. Description of Related Art

In recent years, foods exclusive for a microwave oven have been widely distributed in market, such as frozen foods or the like that are heated and cooked by the microwave oven. On a package of these foods, there is displayed a cooking information indicating standards in heating and cooking the foods by the microwave oven. The cooking information indicates output of a microwave oven and cooking time such as, for example, "cooking is carried out by setting the output to "LOW" and heating for 3 minutes" or "cooking is carried out by heating for 3 minutes at a set output value of 600 W" and so on. However, there is a case where a user of the microwave oven is not aware of rated output of the microwave oven used or a case where the user is not aware of respective output values of "HIGH" or "LOW" to be set.

Further, with the wide distribution of foods exclusive for a microwave oven, the microwave oven becomes high-powered and even a microwave oven having an output of about 500 W to a power exceeding 1 KW is on the market. Accordingly, when heating and cooking are carried out without being aware of output of a microwave oven used, it is unavoidable that excessive heating or insufficient heating is brought about.

Accordingly, as disclosed in Japanese Unexamined Patent Publication No. JP-A-3(1991)-159094, a control unit sets heating/cooking time period in accordance with rated output of a microwave oven by newly correcting it on the basis of such information inputted from an input operating unit and instructs to drive the microwave supplying unit in compliance with the set heating/cooking time period. In this way, even when cooking output information displayed on a food differs from the rated output of a microwave oven used, excessive heating or insufficient heating can be prevented.

However, according to a microwave oven having the above-described control unit, when inputted cooking time information is displayed at the input operating unit and thereafter, the display is abruptly changed to display of cooking time period obtained by the correction, there is a concern where a user mistakenly determines that the microwave oven has failed.

SUMMARY OF THE INVENTION

It is an object of the present invention to provide a microwave oven in which even when a user carries out heating and cooking without being aware of output of a microwave oven used, excessive heating or insufficient heating can be prevented and suitable information can be supplied to the user.

According to an aspect of the present invention, there is provided a microwave oven comprising a main body in which a heating chamber is installed, a microwave supplying unit installed at an inner portion of the main body for heating a food incorporated in the heating chamber by supplying microwave at a predetermined output, an input operating unit for inputting cooking output information and cooking time information of the food, and a control unit for comparing the cooking output information inputted by the input operating unit with the predetermined output, correcting the inputted cooking time information in accordance with a result of the comparison and instructing to drive the microwave supplying unit based on corrected cooking time obtained by the correction, wherein the control unit includes information supplying means for successively supplying the cooking time information inputted by the input operating unit and the corrected cooking time and supplying, after having supplied the cooking time information, "information that the corrected cooking time is being supplied".

DETAILED DESCRIPTION OF THE PREFERRED EMBODIMENT

Figure 1:
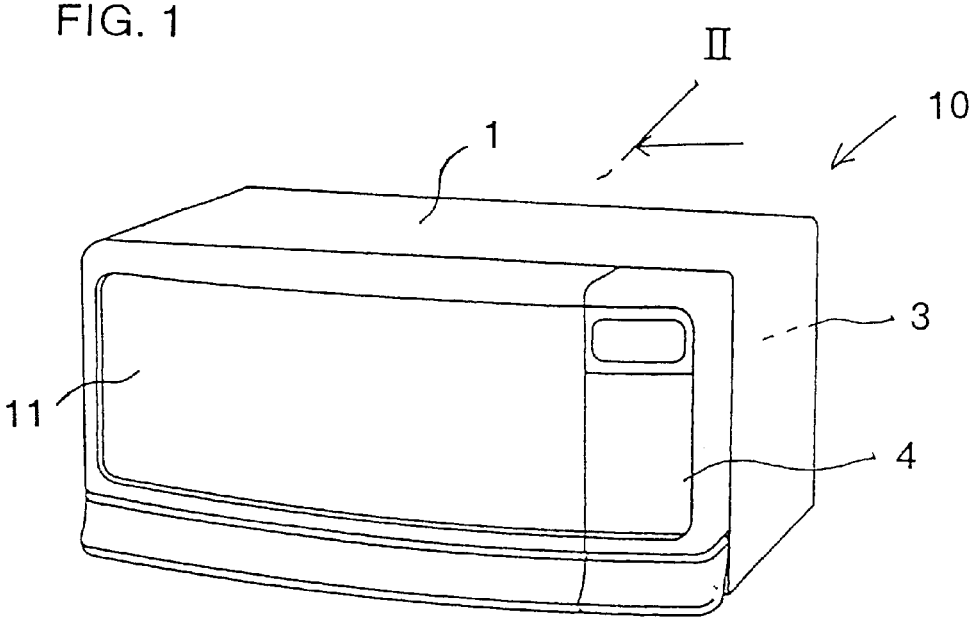
FIG. 1 is a perspective view of a microwave oven according to an embodiment of the present invention.

The present invention is characterized in that the control unit supplies cooking time information and successively supplies "information that corrected cooking time is being supplied" and thereafter, supplies corrected cooking time by the information supplying means. Accordingly, the user is prevented from mistakenly determining that the microwave oven has failed, even in the case where on the basis of the set corrected cooking time the microwave supplying unit is made to stop driving before cooking time period supplied from the cooking time information has elapsed or the microwave heating means does not stop driving even after the cooking time period supplied from the cooking time information has elapsed. Further, the inputted cooking time is not abruptly changed into the corrected cooking time and therefore, the user is prevented from mistakenly determining that the microwave oven has failed.

The cooking output information according to the present invention signifies information displayed in recipe described in a cook book or the like, or on a food exclusive for a microwave oven of frozen food and so on and information displayed in a specific output value of a microwave oven suitable for carrying out predetermined heating and cooking for the food, for example, displayed as "600 W", or information indicating standards of output of a microwave oven of popularized type which can switch output of microwave in plural stages of high, medium, low and the like, as is displayed, for example, as "HIGH", although specific output values are not displayed.

The cooking time information according to the present invention signifies information of time period for setting a timer of a microwave oven suitable for carrying out predetermined heating and cooking for the food based on the cooking output information which is displayed, for example, as "3 minutes" and signifies information indicating standards of cooking time on the basis of the food exclusive for a microwave oven or recipe described in a cook book or the like together with the cooking output information.

The input operating unit according to the present invention signifies inputting means capable of inputting information to the control unit by using a timer knob, numerical value input keys, a select key where cooking menu and corresponding cooking time are predetermined (recipe key) arranged at an operation panel formed at a front face of a microwave oven or the like.

As the information supplying means according to the present invention, a character display unit and an informing sound source are exemplified and specifically, a 7 segment LED display unit, a liquid crystal display, a beep sound source, a sound ROM and a buzzer are pointed out.

The "information that corrected cooking time is being supplied" according to the present invention signifies a message visually or audibly informing the user that a calculation for correcting the cooking time information inputted by the user is being carried out.

Information may be supplied to the user through various means by constituting the information supplying means by displaying means for visually displaying the "information stating that corrected cooking time is being supplied" or informing means for audibly informing thereof.

The information providing means may comprise a character display mechanism and an informing sound source whereby, after displaying the cooking time information by the character display mechanism and successively displaying characters in correspondence with the correction for a predetermined period of time, the informing sound source is driven and the corrected cooking time is displayed and counted down by which the displayed cooking time information and corrected cooking time are prevented from being confused with each other.

Incidentally, the "information that corrected cooking time is being supplied" may be issued in parallel with both or either of the cooking time information and the corrected cooking time or successively.

A detailed description will be given of the present invention based on embodiments shown by the drawings as follows. Incidentally, the present invention is not limited by these.

Figure 2:
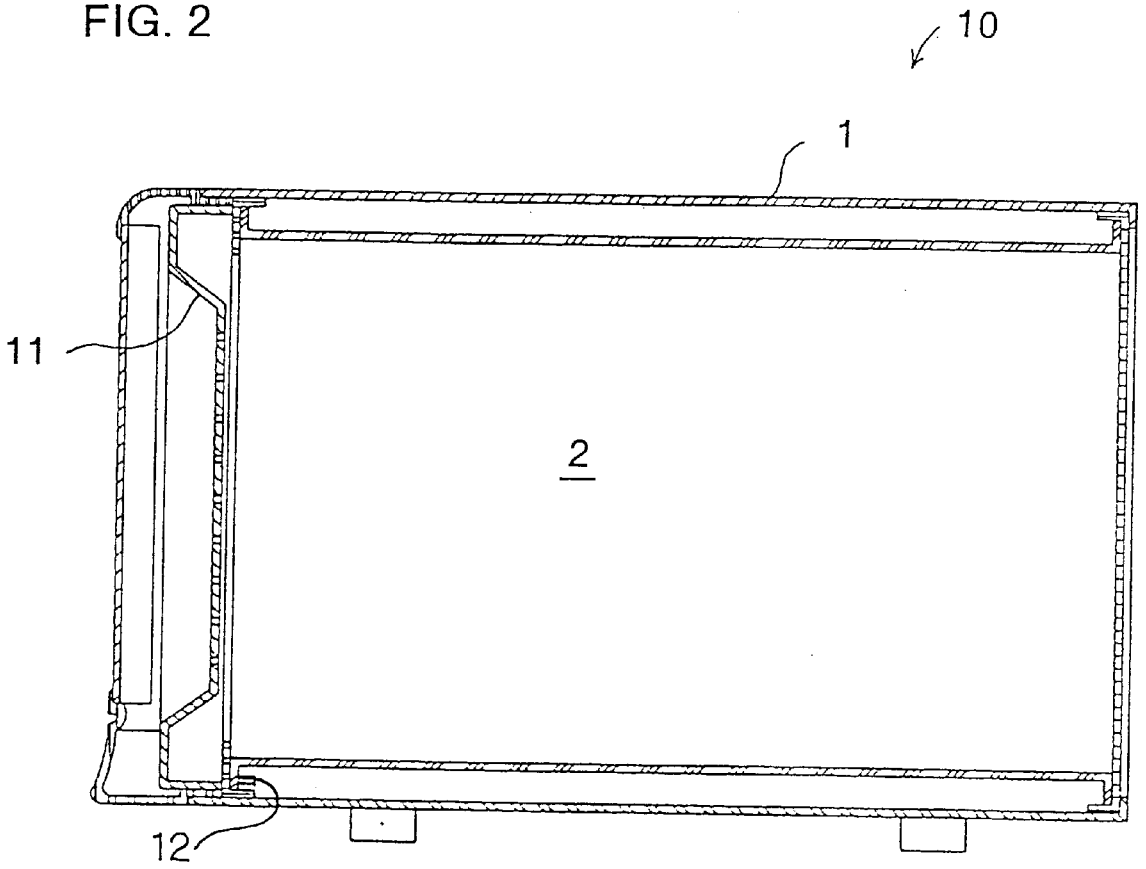
FIG. 2 is a sectional view taken along a line II in the microwave oven of FIG. 1.

FIG. 1 and FIG. 2 show a microwave oven according to an embodiment of the present invention. A microwave oven 10 is constituted mainly by a main body 1, a heating chamber 2 installed at inside of the main body 1 and a microwave supplying unit 3 installed at an inner portion of the main body 1.

The main body 1 is formed in a box-like shape by using face plates each comprising mainly galvanized sheet, in which the heating chamber 2 formed in a box-like shape made of steel sheet and provided with an opened front face is arranged. A door 11 which can close the opening of the heating chamber 2, a door sensor 12 for detecting closing of the door 11 and an operation panel 4 having a control unit (not illustrated) are attached at the front face of the main body 1. The microwave supplying unit 3 is arranged at inside of the main body 1 on the rear side of the operation panel 4.

The microwave supplying unit 3 is constituted by a magnetron (not illustrated) a wave guide and a high voltage transformer and one end of the wave guide is connected to the magnetron and other end thereof is opened to the heating chamber 2. According to the embodiment, the maximum rated output of the magnetron is set to 900 W.

Figure 3:
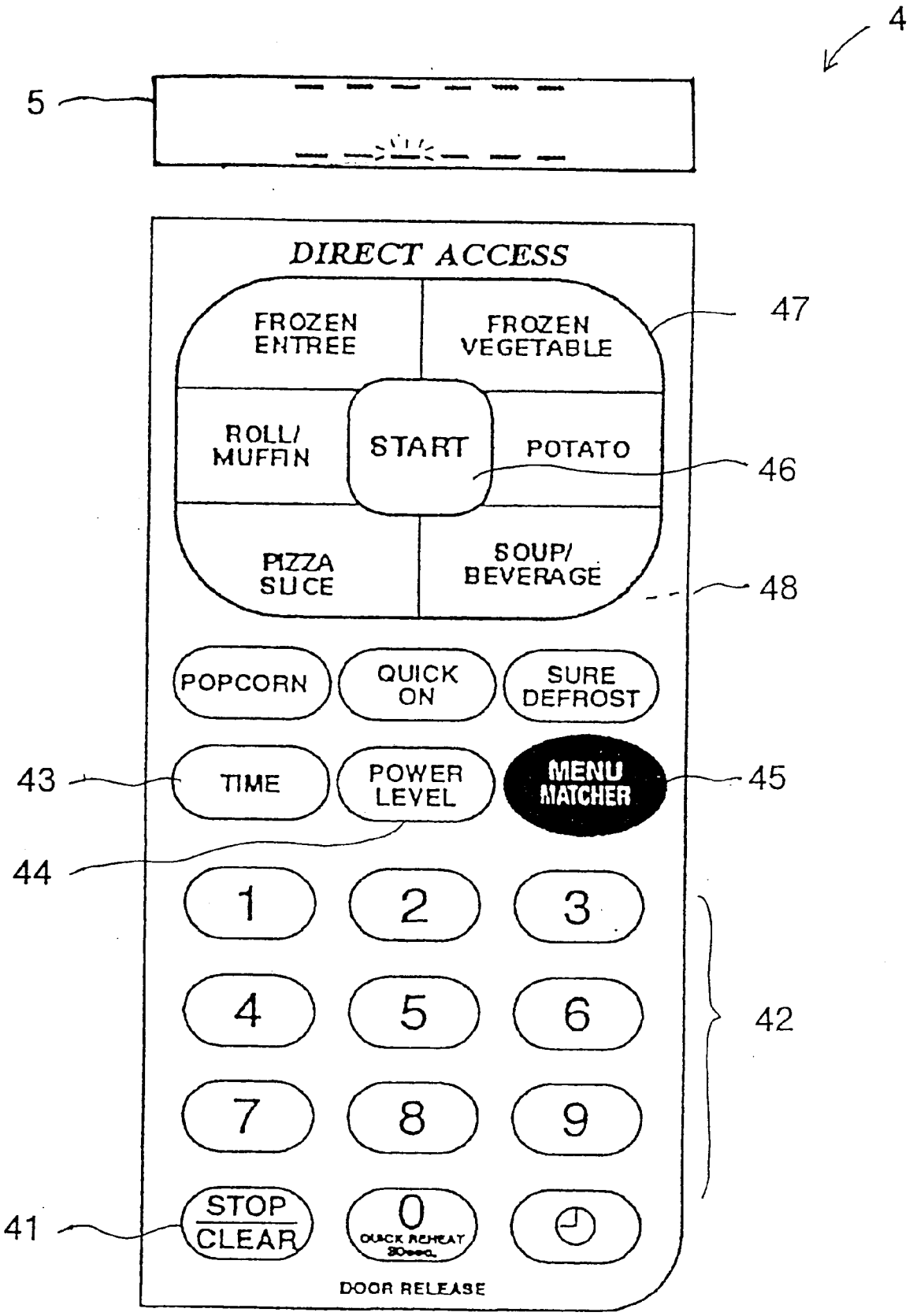
FIG. 3 is a front view of an input operating unit of the microwave oven of FIG. 1.

As shown by FIG. 3, the operation panel 4 comprises a substrate arranged with, from below, a stop key 41, numerical value input keys 42, a time key 43, an output key 44, a correction key 45, a start key 46 and a number of recipe keys 47 and a buzzer 48 is arranged on the inner side of the substrate as information supplying means. Further, a liquid crystal display 5 (character display mechanism) is attached to the upper portion of the operation panel 4 as information supplying means. The liquid crystal display 5 is constituted by display frames of 6 digits and cursor bars arranged at the lower portions of the respective display frames.

The correction key 45 is a key for setting a correction cooking mode for calculating corrected cooking time based on cooking information of food and driving the microwave supplying unit 3 by the calculated corrected cooking time and when the correction cooking mode is set, the output of the magnetron is set to the maximum rated output of 900 W.

Figure 4:
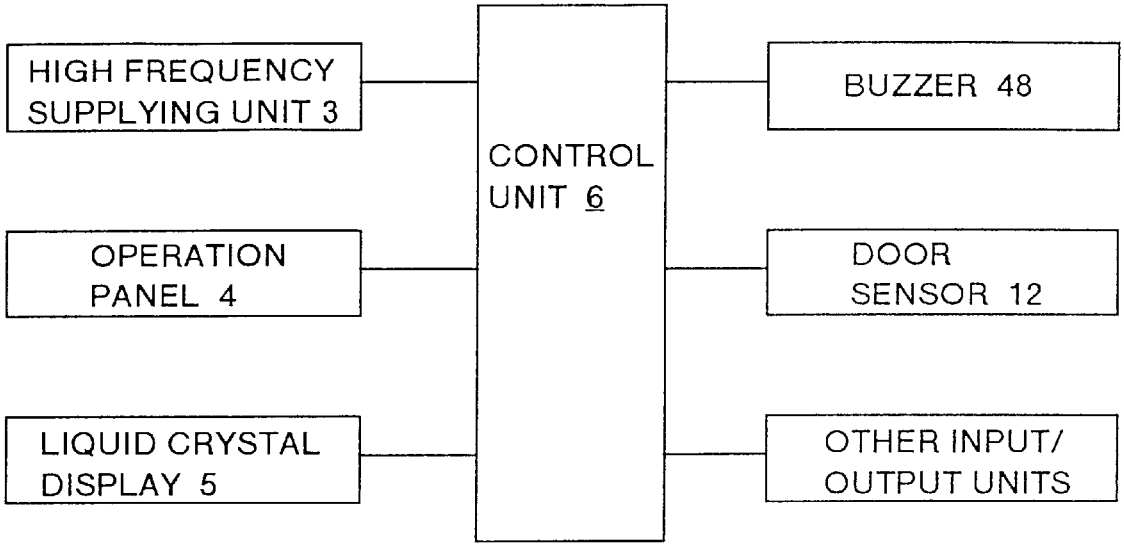
FIG. 4 is a block diagram of a control unit in the microwave oven of FIG. 1.

FIG. 4 is a view constituting control blocks of the microwave oven 10. The microwave oven 10 is provided with a control unit 6 including a microcomputer having CPU, ROM, RAM, timers and so on. The control unit 6 is connected with the microwave supplying unit 3, the operation panel 4, the liquid crystal display 5, the buzzer 48, the door sensor 12 and other input and output units.

Figure 5:
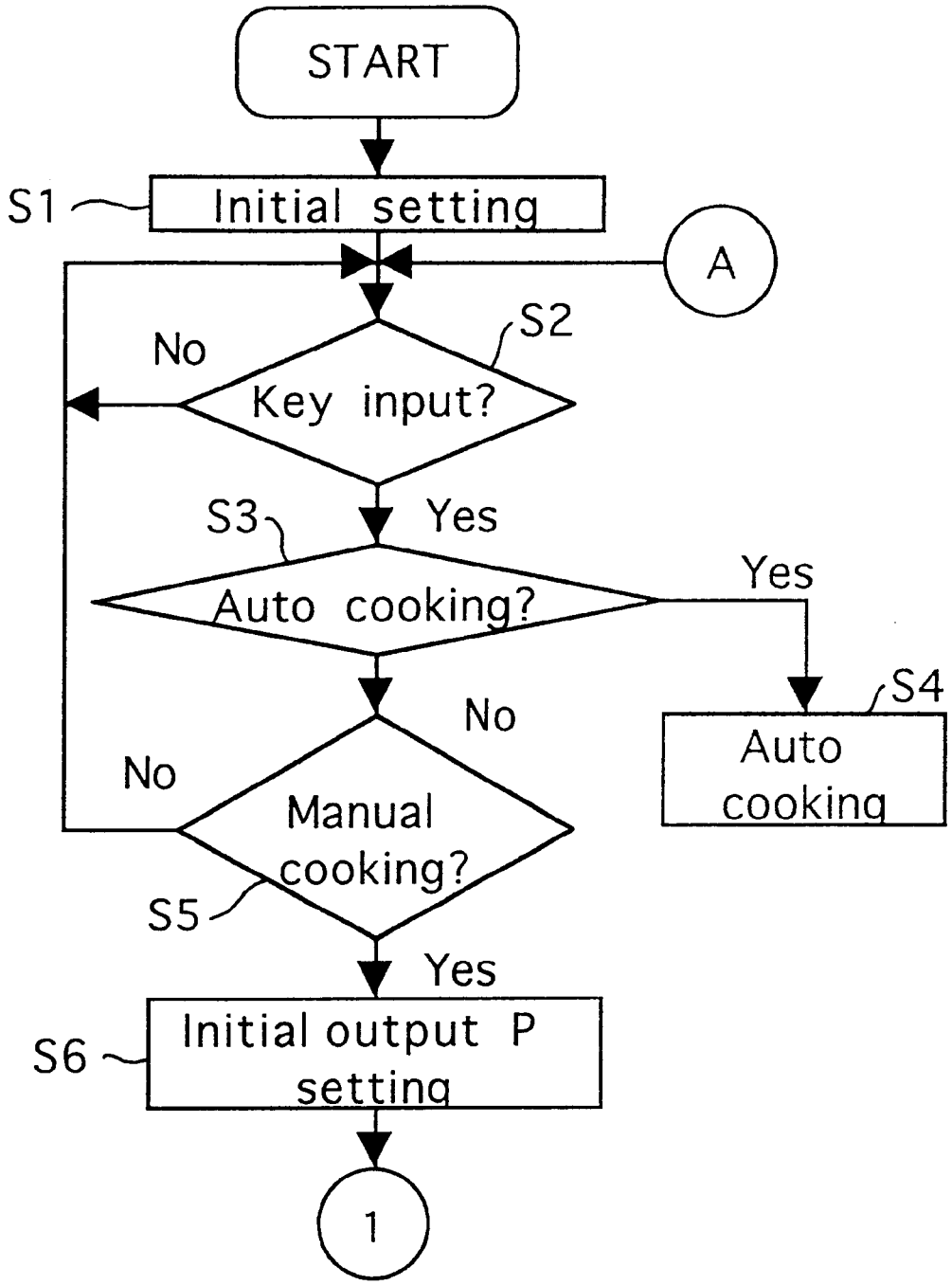
FIG. 5 is a former part of a flow chart for explaining the operation of the control unit.
Figure 6:
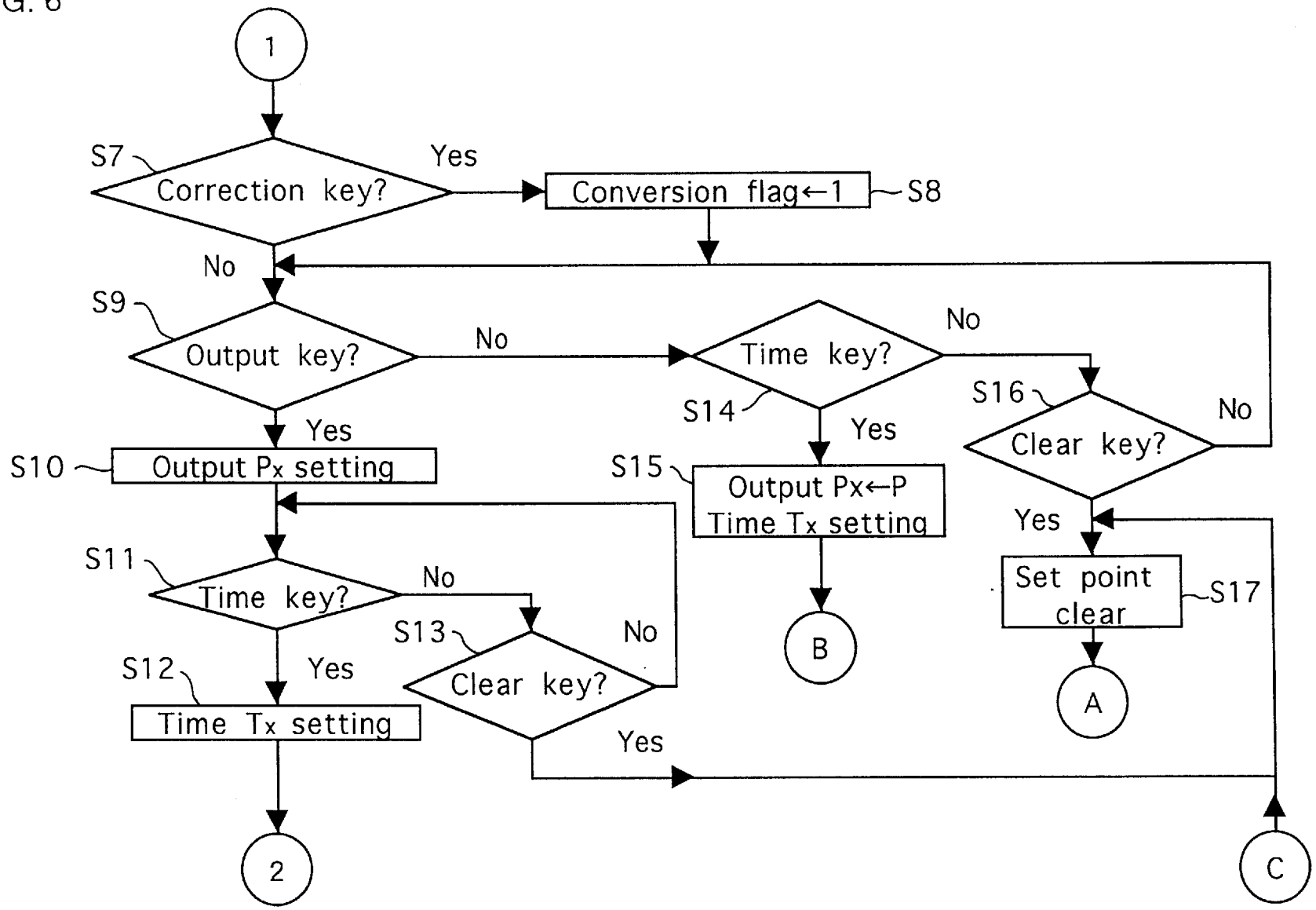
FIG. 6 is a middle part of a flow chart for explaining the operation of the control unit.
Figure 7:
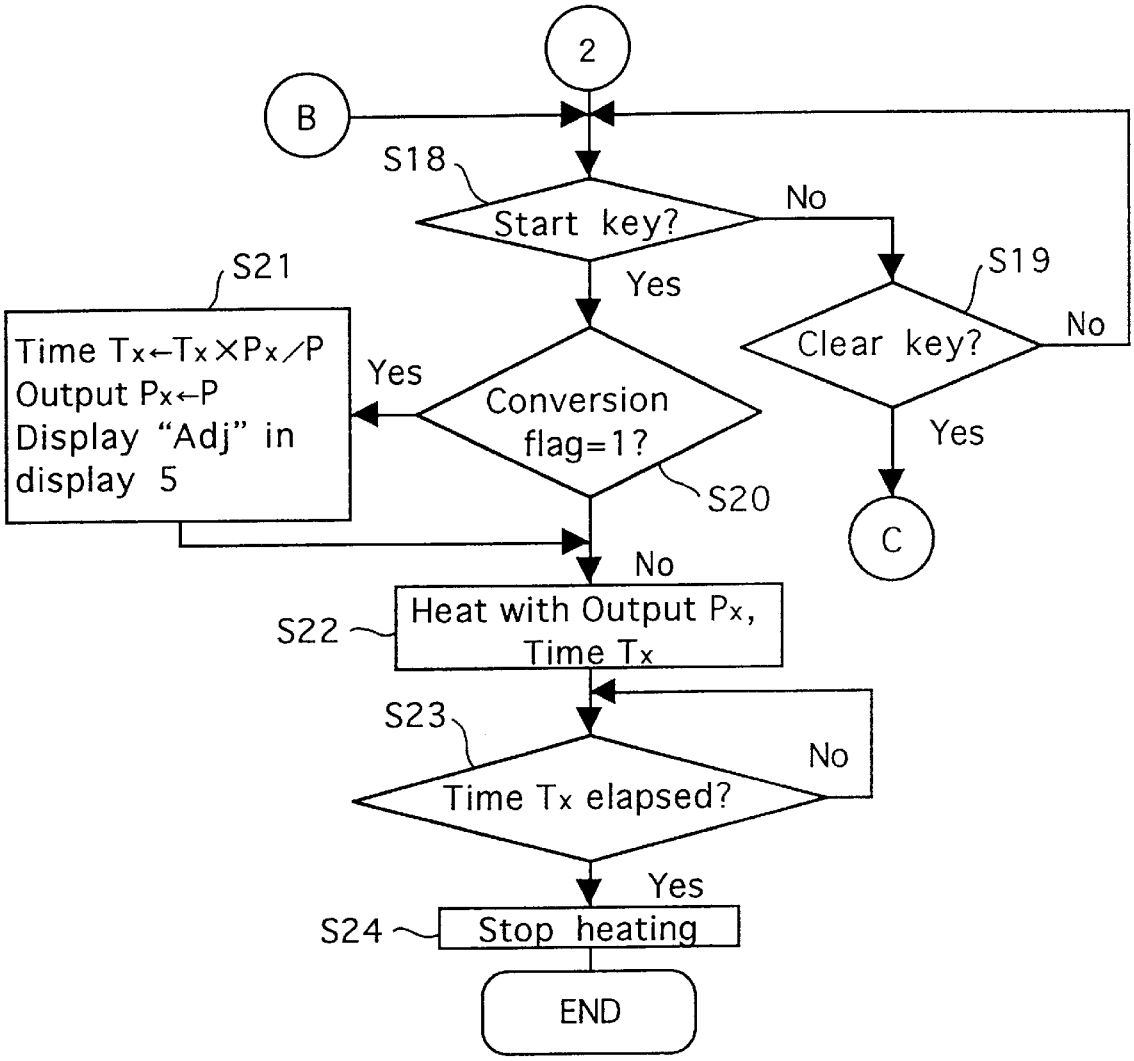
FIG. 7 is a latter part of a flow chart for explaining the operation of the control unit.

An explanation will be given of the operation of the control unit 6 in the microwave oven 10 in accordance with a control flow chart of FIGS. 5~7 as follows. In addition thereto, an explanation will be given of a procedure of supplying information at the liquid crystal display 5 in reference to FIGS. 8(*a*), 8(*b*), 8(*c*), 8(*d*), 8(*e*) and 8(*f*). According to the embodiment, a food "A" exclusive for a microwave oven is heated and cooked and a description stating that "heating and cooking is carried out for 3 minutes with output of 600 W" is attached on the package cover of the food "A".

First, initial setting of resetting flags or the like is carried out in step S1 and whether the recipe key 47 has been pushed is determined in step S2. When it is determined that the recipe key 47 has been pushed, the operation proceeds to step S3 where whether the start key 46 has been pushed for automatic cooking is determined. When it is determined that the start key 46 has been pushed, in step S4, cooking time in correspondence with the recipe key 47 is set and automatic cooking is started by the microwave supplying unit 3.

When it is determined that the start key 46 for automatic cooking has not been pushed in step S3, the operation proceeds to step S5 where whether operation of manual cooking has been carried out is determined.

When the determination in step S5 is YES, initial output of the microwave supplying unit 3 is provisionally determined to the rated output P (900 W). Next, whether the correction key 45 has been pushed is determined in step S7.

When it is determined that the correction key 45 has been pushed, the operation proceeds to step S8 where a conversion flag is set and the operation proceeds to step S9.

Further, when it is determined that the correction key 45 is not pushed, the operation proceed to step S9 where whether the output key 44 has been pushed is determined.

When it is determined that the output key 44 has been pushed in step S9, the operation proceeds to step S10 where output Px is set to 600 W.

In step S10, when the correction key 45 has not been pushed, that is, when the conversion flag has not been set, the user sets an output level described in recipe in a cook book or the like or an output level based on the empirical determination of the user.

The output level can be set by an inputting operation by using the numerical value input keys 42 based on predetermined level values, for example, level values produced by setting the maximum rated output to 10 and the minimum output level (for example, 100 W) as 1 and capable of setting intermediary levels therebetween by numerals at intervals of 1. Incidentally, in setting the output level, the user is not informed of the set output value (W).

Figure 8:
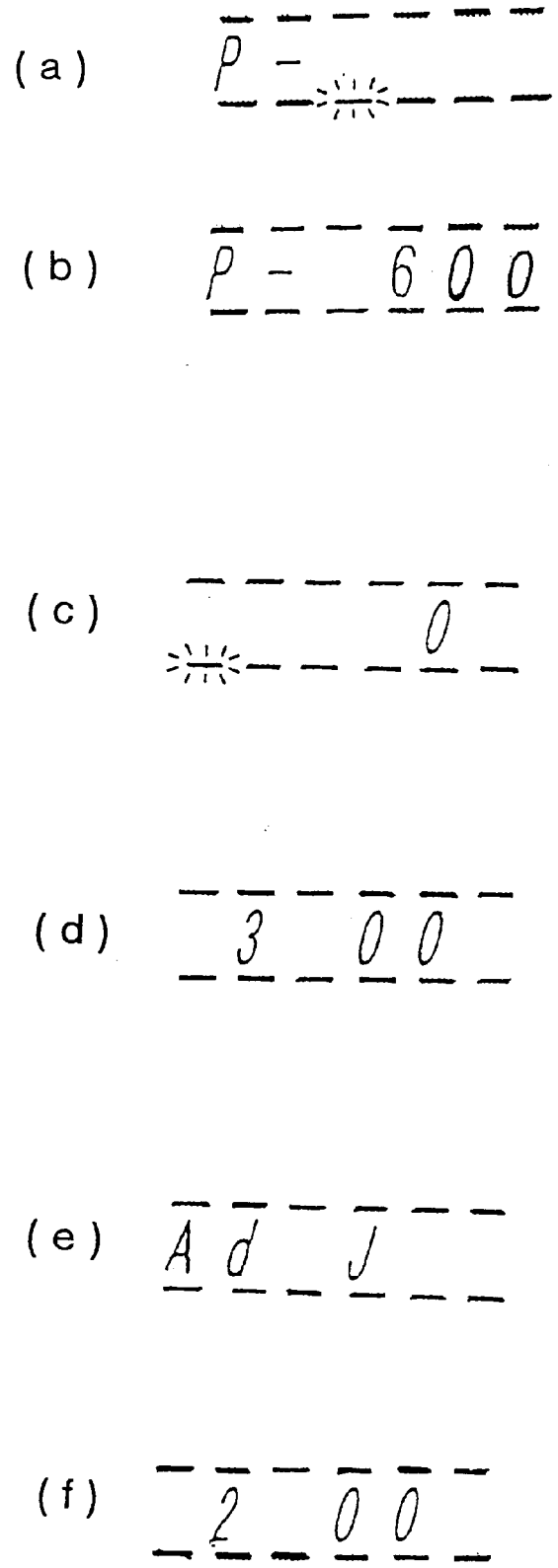
FIGS. 8(*a*), 8(*b*), 8(*c*), 8(*d*), 8(*e*) and 8(*f*) are diagrams showing display content and operational procedure of a display unit which is changed by a correction key at the input operating unit.

Meanwhile, when the correction key 45 has been pushed, that is, when the conversion flag has been set, as shown by FIG. 8(*a*), in the liquid crystal display 5, displaying a character of "P- " and flickering for displaying "awaiting for input" are carried out. Thereafter, the user directly inputs a recommended output value described on the package cover of the food "A". For example, when numerals "6", "0" and "0" have been inputted by successively pushing the numerical input keys 42 based on a description of 600 W, the output Px is inputted as 600 W as shown by FIG. 8(*b*).

Next, at step S11, whether the time key 43 has been pushed is determined. Irrespective of whether the conversion flag has been set, when it is determined that the time key 43 has been pushed, the operation proceeds to step S12 where input of cooking time information Tx by using the numerical input keys 42 is received by hours and minutes.

When the time key 43 has been pushed, as shown by FIG. 8(*c*), flickering of bars for displaying "awaiting for input" is carried out. Next, when numerals "3", "0" and "0" are inputted by successively pushing the numerical input keys 42, the cooking time information Tx is set to 3 minutes 00 second as shown by FIG. 8(*d*).

When the time key 43 is not pushed in step S11, the operation awaits until input is made by using the clear key 41.

Meanwhile, when it is determined in step S9 that the output key 44 has not been pushed, the operation proceeds to step S14 where whether the time key 43 has been pushed is determined. When it is determined that the time key 43 has been pushed, the operation proceeds to step S15 where the rated output P is set as the output Px. Further, input of the cooking time information Tx by using the numerical value input keys 42 is received by hours and minutes. When the time key 43 is pushed, flickering for displaying "awaiting for input" is carried out as shown by FIG. 8(*c*). Next, when numerals "3", "0" and "0" are inputted by successively pushing the numerical value input keys 42, the cooking time information Tx is set to 3 minutes 00 second as shown by FIG. 8(*d*).

When it is determined in step S14 that the time key 43 has not been pushed, the operation proceeds to step S16 where the operation awaits until input is made by using the clear key 41. When input is made by the clear key 41 at step S16, the operation proceeds to step S17 where set content (set point) is cleared and the operation proceeds to step S2.

When the cooking time information Tx is inputted in step S12 and step S15, whether the start key 46 has been pushed is determined in step S18. When the start key 46 has not been pushed, the operation proceeds to step S19 where the operation awaits until input is made by using the clear key 41. When input by using the clear key 41 has been made and it is determined in step S18 that the start key 46 has been pushed, the operation proceeds to step S20 where whether the conversion flag has been set is determined. When it is determined that the conversion flag has been set, the operation proceeds to step S21 where corrected cooking time T is calculated and set in place of the cooking time information Tx.

When the start key 46 has been pushed, as shown by FIG. 8(*e*), a display of "information that corrected cooking time is being supplied" is carried out at the liquid crystal display 5. Specifically, character display of "Adj" (abbreviated display of "adjust") is carried out.

Setting of the corrected cooking time T is calculated by the following equation.

$$\text{(Corrected cooking time T)}=\text{(cooking time information Tx)}\times\text{(output Px/rated output P)} \quad \text{Equation 1}$$

When the calculation by Equation 1 has been finished, simultaneously, the corrected cooking time T is displayed on the liquid crystal display 5. Specifically, as shown by FIG. 8(*f*), 2 minutes 00 second that is a result of a calculation by Equation 1 is displayed. The display of "Adj" signifying "information that corrected cooking time is being supplied" at the liquid crystal display 5 is carried out during calculation of the corrected cooking time T (for example, about 2 seconds), the buzzer 48 is driven simultaneously with the display and the user is informed visually and audibly that the calculation of correcting the cooking time information Tx inputted by the user is being carried out.

When the above-described display is carried out, 2 minutes 00 second of the corrected cooking time T as the cooking time information Tx and the rated output P as the output Px are set as operational conditions (set points) for driving the microwave supplying unit 3. Next, the operation proceeds to step S22 where the microwave supplying unit 3 is started to drive under the above-described conditions. The cooking time information Tx is counted down and displayed at the character display unit 6. When the cooking time information Tx has elapsed, the microwave supplying unit 3 is made to stop driving (steps S23 and 24).

Meanwhile, when it is determined in step S20 that the conversion flag has not been set, operational conditions for driving the microwave supplying unit 3 are set with the output Px of 600 W and the cooking time information Tx of 3 minutes 00 second as have been set in step S10 and step S15, the operation proceeds to step S22 and the microwave supplying unit 3 starts driving under the above-described operational conditions.

In this way, according to the above-described electronic oven 10, the control unit 6 makes the liquid crystal display 5 display the cooking time information Tx inputted by the user, successively displays "Adj" signifying "information that corrected cooking time is being supplied" and thereafter displays the corrected cooking time T. Accordingly, the inputted cooking time is not abruptly changed to the corrected cooking time T and therefore, the user is prevented from mistakenly determining that the microwave oven has failed.

The buzzer 48 is driven simultaneously with the display of "Adj" at the liquid crystal display 5 and therefore, the user can be both visually and audibly informed beforehand that the cooking time displayed successively on the liquid crystal display 5 is the corrected cooking time T.

Further, the informing means may be constituted such that a voice ROM recording a message in Japanese, English or the like is attached in place of the buzzer 48 or together with the buzzer 48 and the control unit 6 instructs to drive the voice ROM.

Although according to the above-described embodiment, in step S10, when the correction key 45 has not previously been pushed, that is, when the conversion flag has not been set, the user inputs a level value (10, 9, 8 . . . ) based on an output level described in recipe of a cook book or the like or an output level based on the empirical determination of the user, a further simplified constitution of setting an output level will be shown in the following.

That is, the user directly inputs a recommended output value described on the package cover of the food. For example, when numerals "6", "0" and "0" are inputted by successively pushing the numerical value input keys 42 based on a description of 600 W, as shown by FIG. 8(*b*), the output Px may be inputted as 600 W.

In this case, a further convenient function is achieved by a constitution where the inputted output value Px is set to the maximum output value or lower even when the user is not informed of the maximum output value (W) of a microwave oven used or even when an output exceeding the maximum output value (W) is set.

Although according to the above-described embodiment, in step S10, when the correction key 45 has been pushed previously, that is, when the conversion flag has been set, the output value is directly inputted in the liquid crystal display 5, a further simplified constitution of setting the output level will be shown in the following.

Figure 9:
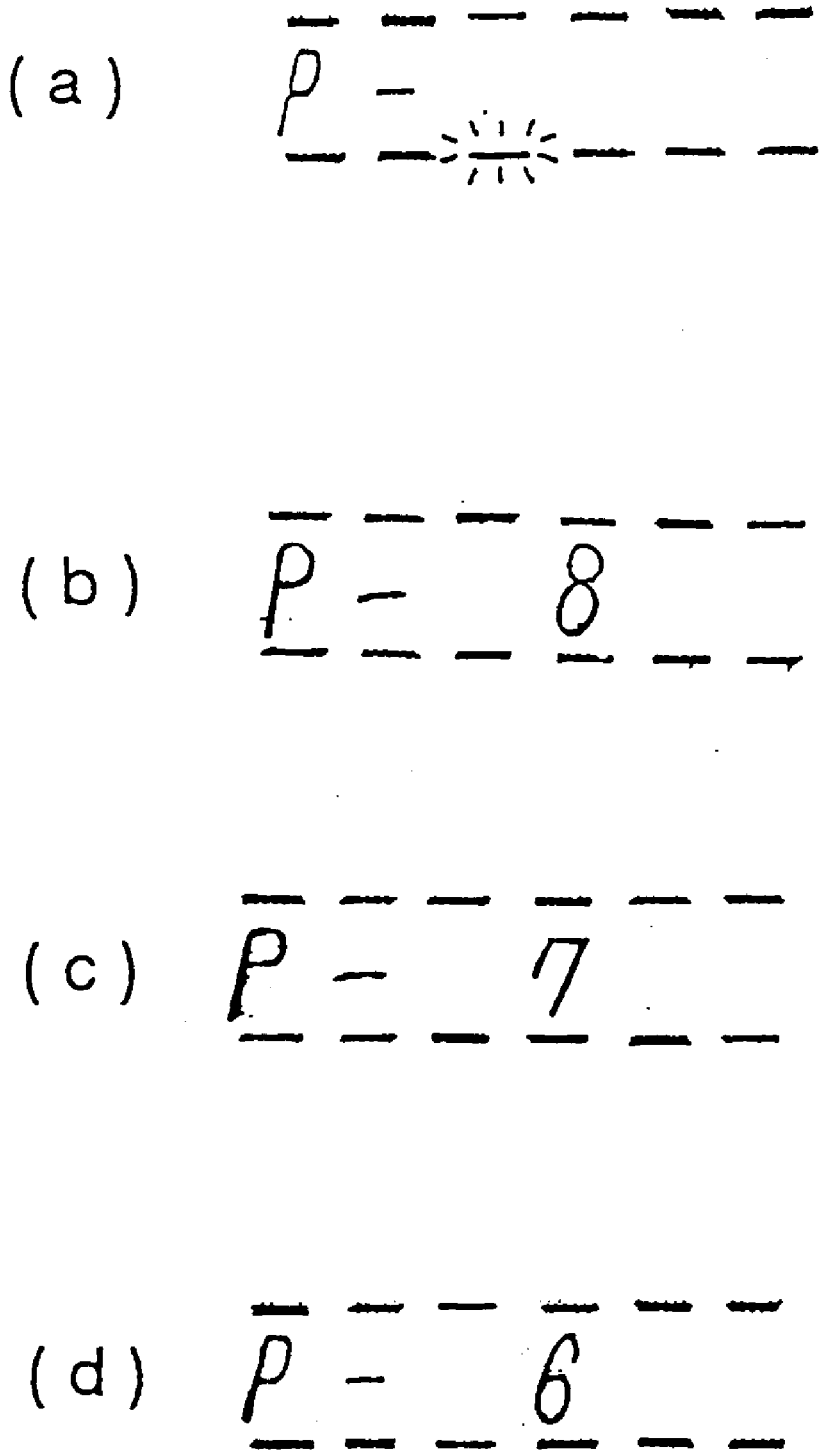
FIGS. 9(*a*), 9(*b*), 9(*c*) and 9(*d*) are diagrams in correspondence with FIGS. 8(*a*), 8(*b*), 8(*c*), 8(*d*), 8(*e*) and 8(*f*) showing display content and operational procedure of the display unit which is changed by the correction key of the input operating unit according to another embodiment.

That is, as shown by FIG. 9(*a*), in the liquid crystal display 5, character display of "P-" and flickering for displaying "awaiting for input" are carried out. Next, input for setting the output Px of the microwave supplying unit 3 by the correction key 45 is successively received. When the correction key 45 is pushed once, "P- 8" representing 800 W is displayed as shown by FIG. 9(*b*), when it is pushed once more, "P- 7" representing 700 W is displayed as shown by FIG. 9(*c*) and when it is pushed once more successively, "P- 6" representing 600 W is displayed as shown by FIG. 9(*d*), in this order. Under such a constitution, the output level can be set only by operating the correction key 45.

Figure 10:
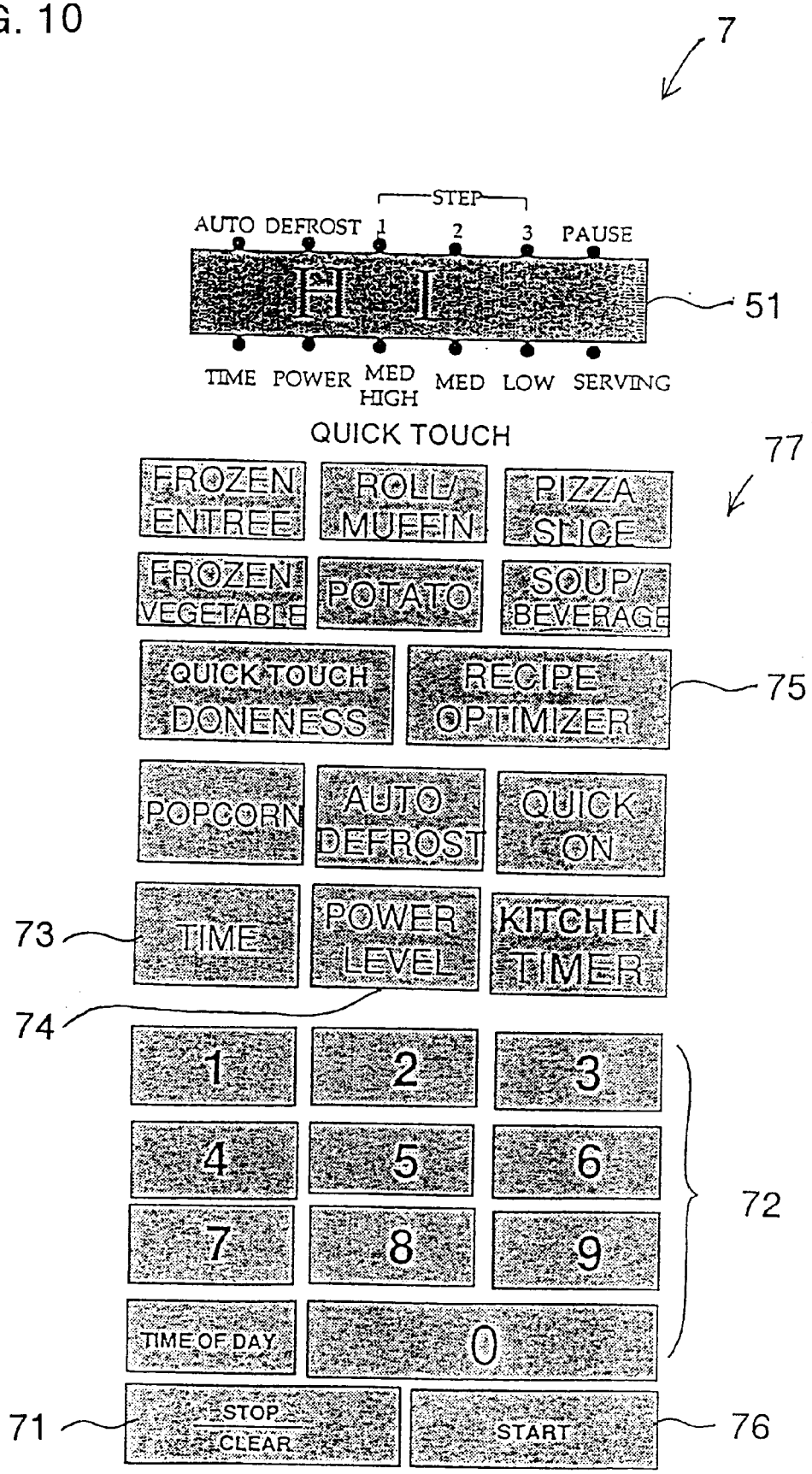
FIG. 10 is a view in correspondence with FIG. 3 showing an input operating unit according to another embodiment.

FIG. 10 shows another embodiment of the information supplying means. In this case, a magnetron having the maximum rated output of 1000 W is prepared, an operation panel 7 comprises a substrate arranged with, from below, a stop key 71, a start key 76, numerical input keys 72, a time key 73, an output key 74, a correction key 75 and a number of recipe keys 77, and a liquid crystal display 51 is attached at the upper portion of the operation panel 7 as information supplying means. The liquid crystal display 51 comprises a display frames of 6 digits and LED lamps arranged above and below of the display frames.

Similar to the correction key 45 in the above-described embodiment, the correction key 75 is a key for calculating the corrected cooking time T based on cooking information of food and setting a correction cooking mode for driving the microwave supplying unit 3 by the calculated corrected cooking time T.

A difference between constitutions of the operation panel 4 of the control unit 6 in the above-described embodiment and the operation panel 7 resides in that when the conversion flag has been set, at step S10 in the control flow chart, when the correction key 75 of FIG. 10 is pushed once, the output Px is set to "HI", that is, "high" output, for example, 1000 W, when it is pushed successively twice, the output Px is set to "MEDHI", that is, "medium high" output, when it is pushed successively three times, the output Px is set to "MED", that is, "medium" output and when it is pushed successively four times, the output Px is set to "LOW", that is, "low" output, for example, 500 W. When the conversion flag has not been set, the output value is set by setting the output level by using the output key 74 similar to the above-described embodiment.

Meanwhile, when the conversion flag has been set in step S20, the operation proceeds to step S21 where the corrected cooking time T is set by the above-described setting conditions. As the output Px in this case, an initial output P, that is, 1000 W is set.

When it is determined in step S20 that the conversion flag has not been set, the operational conditions for driving the microwave supplying unit 3 are set as have been set at step S10, for example, 500 W in correspondence with the output Px "LOW" and the cooking time information Tx of 3 minutes 00 second and the operation proceeds to step S22 where the microwave supplying unit 3 is made to start driving under the above-described operational conditions.

According to the above-described respective embodiments of the microwave oven, when the correction cooking mode is set, the microwave supplying unit 3 is driven at the maximum rated output and accordingly, a time period required for heating and cooking is shortened.

According to the microwave oven of the present invention, the control unit supplies the cooking time information successively supplies "information that corrected cooking time is being supplied" and thereafter supplies the corrected cooking time by the information supplying means and accordingly, even in the case where on the basis of the set corrected cooking time, the microwave supplying unit is made to stop driving before the cooking time supplied by the cooking time information has elapse d or the microwave heating means is not stopped to drive even after the cooking time supplied by the cooking time information has elapse d, the user is prevented from mistakenly determining that the microwave oven has failed.

Thereby, the present invention can provide a microwave oven which can prevent excessive heating or insufficient heating and can supply pertinent information to the user even in the case where the user carries out heating and cooking without being aware of the output of the microwave oven used.

What we claim is:

1. A microwave oven comprising:

a body including a heating chamber;

microwave generating means, in said body, for generating microwaves, at a predetermined power level, for heating food in said heating chamber;

input means for inputting power level information and cooking time information; and a control unit for comparing power level information inputted by said input means with said predetermined power level, correcting said inputted cooking time information in accord with the result of said comparison, and controlling said microwave generating means in accord with said corrected cooking time;

said control unit including information output means for successively outputting both said cooking time information, inputted by said input means, and said corrected cooking time, the latter being identified as "corrected".

2. The microwave oven according to claim 1, wherein said information output means comprises display means for visually displaying said corrected cooking time.

3. The microwave oven according to claim 1, wherein said information output means comprises sound generating means for audibly outputting said corrected cooking time.

4. The microwave oven according to claim 1, wherein said information output means comprises:

visual display means for successively displaying said cooking time information and said corrected cooking time information and, thereafter, for counting down and displaying said corrected cooking time; and sound generating means for generating an audible signal when said microwave generating means is activated.

* * * * *